US007694634B2

(12) United States Patent
Wiebe et al.

(10) Patent No.: US 7,694,634 B2
(45) Date of Patent: Apr. 13, 2010

(54) ADJUSTABLE MOUNTING SYSTEM FOR MULTIMEDIA WALL SHELF UNITS

(75) Inventors: John Wiebe, Oakville (CA); Jeff Archbold, Pickering (CA)

(73) Assignee: Sonic Integrity Canada Ltd., Mississauga, Ontario (CA)

( * ) Notice: Subject to any disclaimer, the term of this patent is extended or adjusted under 35 U.S.C. 154(b) by 431 days.

(21) Appl. No.: 11/677,345

(22) Filed: Feb. 21, 2007

(65) Prior Publication Data

US 2007/0193481 A1 Aug. 23, 2007

(30) Foreign Application Priority Data

Feb. 22, 2006 (CA) ..... 2537483

(51) Int. Cl.
*A47B 5/00* (2006.01)

(52) U.S. Cl. ..... 108/152

(58) Field of Classification Search ..... 403/346, 403/396, 400, 398; 312/7.2, 245; 108/152, 108/193, 180; 211/87.01, 189, 194, 183; 248/250, 235, 247, 248; 52/719
See application file for complete search history.

(56) References Cited

U.S. PATENT DOCUMENTS 2,842,270 A * 7/1958 Massey ..... 108/31
2,942,366 A * 6/1960 Pfaff, Jr. et al. ..... 40/624
3,341,959 A * 9/1967 Sabadics ..... 40/607.12
3,879,096 A * 4/1975 Blodee ..... 312/265
3,958,351 A * 5/1976 Summey ..... 40/607.12
4,349,171 A * 9/1982 Baldwin ..... 248/243
4,793,580 A * 12/1988 Richards ..... 248/188
5,718,493 A * 2/1998 Nikolai ..... 312/245
5,762,436 A * 6/1998 Mosdal ..... 403/3
5,921,411 A * 7/1999 Merl ..... 211/90.01
6,106,189 A * 8/2000 Seale ..... 403/398
6,561,473 B1 * 5/2003 Ianello ..... 248/219.4
6,615,551 B2 9/2003 Chesser et al.
6,629,614 B2 10/2003 Jordan
6,727,606 B2 4/2004 Schopp et al.
6,872,027 B2 * 3/2005 Ledingham ..... 403/400
7,261,213 B2 * 8/2007 Strating et al. ..... 211/87.01
2004/0258472 A1 * 12/2004 Petratto ..... 403/400
2005/0253035 A1 11/2005 Dozier
2008/0226389 A1 * 9/2008 James ..... 403/400

* cited by examiner

*Primary Examiner*—Janet M Wilkens
*Assistant Examiner*—Dan Rohrhoff
(74) *Attorney, Agent, or Firm*—Gerald A. Gowan; Gowan Intellectual Property

(57) ABSTRACT

An adjustable mounting system for wall-mounted shelf units is provided. The mounting system of the shelf unit comprises at least one horizontal support, situated preferably in proximity to the wall surface near the upper section of the shelf unit. The horizontal support is attached to, and slides laterally in clamping brackets that have been mounted to a wall. One part of the brackets are designed to be fastened to wall vertical support columns or studs, and incorporate a second portion that provides a clamping mechanism that attaches to the horizontal. The horizontal support is preferably fastened at each end to the shelf unit. One or more vertical columns are located between the shelves of the shelf unit and are located proximal, and optionally anterior to the horizontal support. A clamping element, which is preferably a plate with holes drilled into it, is placed proximate to the vertical support columns. The vertical support column and the horizontal support are clamped together using the clamping element and preferably with U-bolts. The nuts on the U-bolt are adjustable for clamping pressure. The shelf unit is particularly well suited for holding electronic equipment.

12 Claims, 2 Drawing Sheets

ADJUSTABLE MOUNTING SYSTEM FOR MULTIMEDIA WALL SHELF UNITS

FIELD OF THE INVENTION

This invention relates to wall-mounted furniture, and in particular, to furniture that is used to support electronic equipment, including flat-panel televisions, home theatre audio components, and video replay/recording devices such as DVD players, and well as media software. In particular, the invention relates to the mounting systems used to mount such furniture on a wall surface.

BACKGROUND OF THE INVENTION

The advent of flat-panel televisions has allowed televisions to be placed on walls, since the thinner televisions do not project out into a room to the same extent that a conventional cathode-ray-tube (CRT) television must do.

The electronic accoutrements for a flat-panel television, such as a DVD player or VCR, are typically located in close proximity to the television. Once a flat-panel television is mounted to a wall, there is a need for a shelf unit that will support not only the flat-panel television, but also the associated electronics.

The prior art has described shelf units that fasten to walls. However, due to the weight of electronic components, the shelf units should be securely fastened to vertical wall studs in order to ensure maximal strength and resistance to sag and failure. Since vertical wall studs are not typically located at locations that allow for optimal visual placement of the wall shelf units, prior art has limited the locations at which a shelf unit with high load-bearing capacity can be placed.

Furthermore, due to the cantilevered loading on prior art, the issue of shelf sag, from the back to the front of the shelf, under load has required stiff, and costly, shelf units, and/or complex stiffening systems to counteract the downward cantilevered loads. The need for a simple wall shelf mounting system that permits lateral adjustability for aesthetic and structural reasons, combined with a simple stiffening system to counteract downward cantilevered loading typical of wall shelf units for flat-panel televisions and associated electronics can be clearly seen.

As such, there is a need for a cabinet or shelving unit that can accommodate thin display media, and which can be rapidly and easily mounted on a wall.

In U.S. Pat. No. 6,615,551, a media wall support is shown which includes an upright vertical wall to which equipment can be mounted. However, this requires a complete wall section to be used.

As such, it is an objective of the present invention to provide a cabinet or shelf unit that can be easily mounted securely on a wall. It is an additional objective of the present invention to provide a shelf unit that is well suited for use with modern electronic equipment. It is a still further objective of the present invention to provide a shelf unit that permits easy adjustment of the shelf attachment mechanism to ensure that the shelves of the shelf unit are maintained in a level orientation, and thus are resistant to sag due to the cantilevered loading on the shelf.

SUMMARY OF THE INVENTION

The objectives set out hereinabove, as well as other objects and goals inherent thereto, are at least partially or fully provided by the shelf unit, and the shelf unit mounting assembly of the present invention, as set out herein below.

Accordingly, in one aspect, the present invention provides an adjustable mounting system for wall-mounted shelf units comprising:

a horizontal support element fastened between opposing lateral faces of two sides of a shelf unit;

a series of clamping brackets that are adapted to be securely fasten to a wall surface and which incorporate a region, and preferably a circular, concave region that at least partially matches the cross-sectional structure of the horizontal support element, so that said horizontal support element is supported by said brackets, a vertical support element which is fastened between a top shelf and a lower shelf, and which is placed anterior to and adjacent to the horizontal support element;

a clamping element that is placed anterior to and adjacent to the vertical support element, a connecting element, which preferably is a U-bolt, which is reversibly connected to said clamping element, and which extends around said horizontal support element so that tightening of said connecting element compresses said horizontal support element, said vertical support element, and said clamping element together.

In a further aspect, the present invention also provides a shelf unit incorporating the adjustable mounting system, as described hereinabove.

In a still further aspect, the present invention also a method or using the mounting system described hereinabove, comprising, attaching the clamping brackets to a wall or other surface, connecting the horizontal support element to the clamping brackets so that said horizontal support element is positioned within a region of said clamping bracket; optionally laterally positioning said shelf unit by sliding said horizontal support element in said region of said clamping bracket; positioning a clamping element anterior to said vertical support element; passing a connecting element around the horizontal support element and connecting said connecting element to a clamping element, which clamping element is positioned anterior to said vertical support element; and tightening the connection between the connecting element and the clamping element, in order to cause rotation of said shelf unit around the horizontal support element.

DETAILED DESCRIPTION OF THE INVENTION

Preferably, the connecting element is a U-bolt which passes around said horizontal support element, and more preferably, at least 2 U-bolts are used for each clamping element so that a connecting element is located on two sides of the vertical support element.

The clamping element is preferably a separate element that is positioned anterior to the vertical support element. However, portions of the clamping element could be combined into the vertical support element. For example, the clamping element could be permanently attached to the vertical support element.

Preferably, the top and lower shelf, and any additional shelves present in the shelf unit are connected at each end to the opposing lateral faces of the sides of the shelf unit. The additional shelves can be located above or below the top or the lower shelf, or in between the top and the lower shelf which are connected to the vertical support.

Preferably, the horizontal support element is positioned to be substantially parallel to the top surface of the shelf unit, and is preferably located at a position which is in the upper half to the shelf unit. The horizontal support element is preferably cylindrical in cross-section, but might also be any suitable shape, such as square, polygonal or the like.

Optionally, a plurality of horizontal elements and/or vertical elements might be provided in a single shelf unit, and the user has the option of connecting one or more of a series of positions where the horizontal and vertical elements are adjacent to one another.

In one embodiment, a plurality of clamping elements might be used to provide a plurality of connections between the horizontal and vertical support elements. Commonly, however, only one horizontal and one vertical elements are provided, or are necessary, so that only one clamping element is used.

Preferably, the cross-sectional shape of the region for holding the horizontal support element in the bracket matches the cross-sectional shape of the horizontal support element. As such, the horizontal element, and thus the shelf unit, can preferably be moved laterally when the horizontal element is positioned within the bracket.

Preferably, the horizontal support element is also cylindrical in cross-section, but again, any suitable shape such as square or polygonal might be used.

The shelf unit can be of any suitable shape or size, but preferably includes a flat top surface. Further, while a number of shelves might be provided in a shelf unit, a simple shelf unit is in the shape of a box, with two side panels, a top panel and a bottom panel.

As such, the present invention combines lateral and rotational adjustability, and provides stiffening elements to counter the expected loading forces, and provides these in a relatively simple system. This mounting system is intended to be incorporated into a wall shelf unit typically comprising one structural panel on each side, along with a top and bottom structural panel. Intermediate shelves and a front face/cover panel are also possible as part of the complete wall shelf unit.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
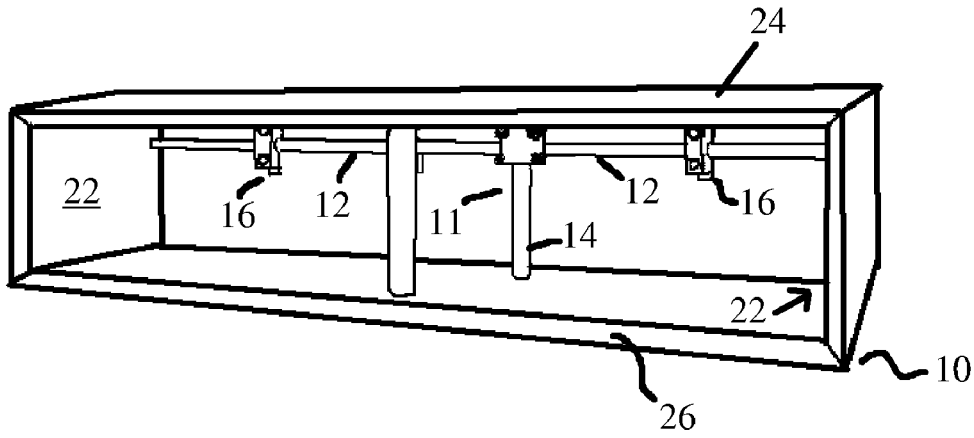
FIG. 1 is a front perspective view of a shelf unit with a mounting system of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a simple shelf unit 10 is shown which incorporated the adjustable mounting system 11 of the present invention. Mounting system 11 comprises a circular horizontal support element 12 connected to the opposed lateral surfaces 22 of shelf 10, a circular vertical support element 14 connected to the top shelf 24 and a lower shelf 26, wall mountable clamping brackets 16, a flat clamping element 18, and two U-bolt connecting elements 20 (with bolts). Clamping element 18 is provided with 4 holes 28 adapted and positioned to received the two ends of two U-bolts.

Figure 2:
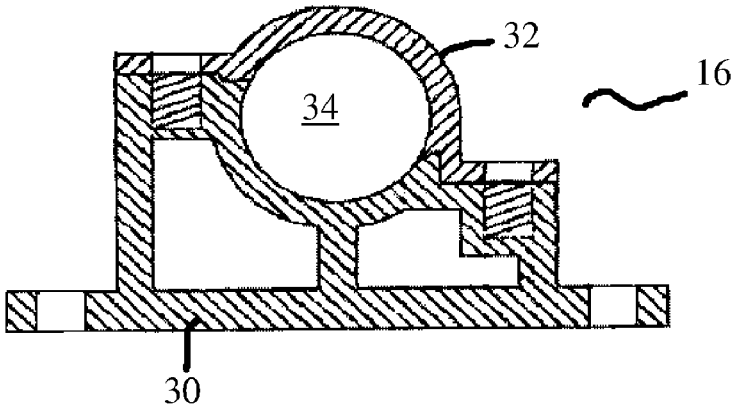
FIG. 2 is a cross sectional view of a clamping bracket to be used in the mounting system.

The details of wall mountable clamping brackets 16 are shown in detail in FIG. 2 which is a cross sectional view of a complete bracket. Bracket 16 however, is typically composed of a first part 30 and a second part 32 which parts are adapted to be connected together by bolts or the like, in order to create a bracket 16 having circular region 34 in which horizontal support element 12 is to be positioned. In use, first part 30 of bracket 16 is attached to a wall or any other suitable surface using any of a number of suitable means, including, for example, bolts, anchors, nails, screws, or the like.

Horizontal support element 12 is then positioned within the semi-circular element of first part 30 which will ultimately form region 34. Second part 32 is then fastened to first part 30 to create bracket 16 so that horizontal support element 12 is held within region 34 of bracket 16. While bracket 16 now supports the weight of shelf unit 10, the connection between bracket 16 and horizontal support element 12 need not be a tight fit so that horizontal support element 12 may be moved laterally within bracket 16. This might also be achieved by laterally moving horizontal support element 12 to a suitable position before second part 32 is tightly connected to part 30 of bracket 16. Thus, further lateral movement is prevented.

Brackets 16 would, by necessity, be installed in locations dependant on the structure of room. However, since the position of brackets 16 is not critical in the positioning of shelf unit 10, brackets 16 can be located in positions where they are best suited, such as, for example, in a position where they might be connected to a support stud for a wall, or the like.

Figure 3:
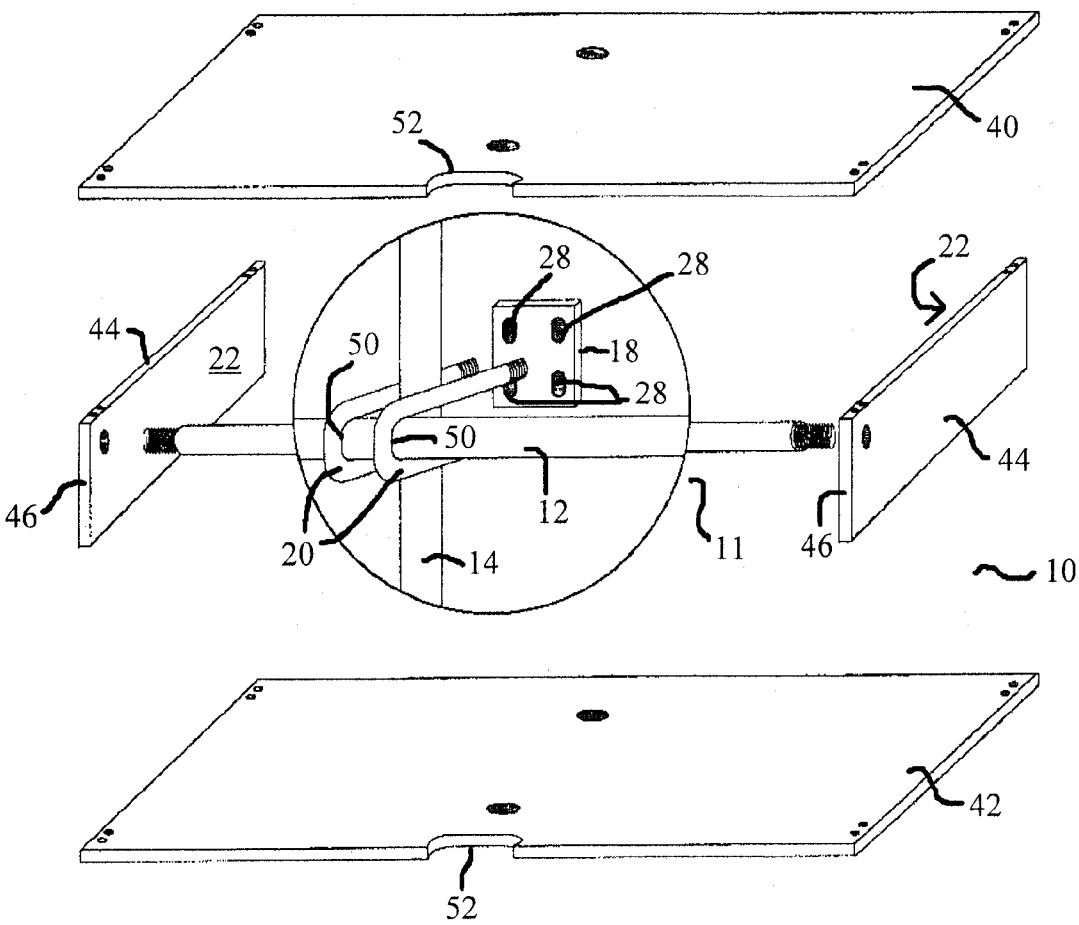
FIG. 3 is an exploded, rear perspective view of the shelf and mounting system of FIG. 1.

In FIG. 3, an exploded, top view, perspective image of a shelf unit 10 is shown and which also shows most of the elements of the mounting system 11 of the present invention. The image is shown from the rear of the shelf unit 10, and the connection between the horizontal and vertical support elements (12, 14) is enlarged.

Horizontal support element 12 is installed into the basic shelf unit, connecting the two side panels 44. In this figure, shelf unit 10 comprises a top panel 40, a bottom panel 42, and the two side panels 44. The horizontal support element 12 is preferably positioned near the top panel 40 of shelf unit 10, as well as being proximal to the rear edge 46 of side panels 44. Vertical support column 14 would be installed into a predetermined location between the top and bottom panels (40, 42). Once the basic shelf unit 10 is assembled, it is placed onto the brackets secured to the wall studs.

Vertical support element 14 is preferably located slightly anterior to the horizontal support element 12, such that a gap between them exists prior to the installation of the U-bolts 20 and clamping bracket 18. By placing the bell 50 of the U-bolts 20 posterior to the horizontal support element, and with the threaded ends directed to the front of shelf unit 10, the clamping plate 18 can be placed over the threaded ends of the U-bolts 20 using holes 28. The clamping element is thus positioned anterior to both the horizontal and vertical support elements (12, 14). Tightening threaded nuts (not shown) over U-bolts 20 compresses the vertical support element 14 towards the horizontal support element 12. This clamping acts as a stiffener and leveler to counteract the downward cantilevered loads on the shelf unit which would be provided from a flat-panel television, other electronic components, or the like.

A notch 52 can be provided to allow wires or the like to pass in to or out of shelf unit 10. Notch 52 is shown in the top and bottom panel (40, 42), but could equally be provided in the side panels 44.

Thus, it is apparent that there has been provided, in accordance with the present invention, a wall mounted shelf, and attendant mounting system, which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

We claim:

1. An adjustable mounting system used, in combination with a wall-mounted shelf unit comprising:

a horizontal support element fastened between opposing lateral faces of two sides of said shelf unit;

a series of clamping brackets that are adapted to be securely fastened to a wall surface and which incorporate a region that at least partially matches the cross-sectional structure of the horizontal support element, so that said horizontal support element is supported by said brackets;

a vertical support element which is fastened between a top shelf and a lower shelf of said shelf unit, and which is placed anterior to and adjacent to the horizontal support element;

a clamping element that is placed anterior to and adjacent to the vertical support element;

a connecting element which is reversibly connected to said clamping element, and which extends around said horizontal support element so that tightening of said connecting element compresses said horizontal support element, said vertical support element, and said clamping element together.

2. The mounting system of claim 1 wherein the horizontal support element, and said region in said clamping bracket are both cylindrical in cross-section.

3. The mounting system of claim 1 wherein the horizontal support element, and said region in said clamping bracket are both polygonal in cross-section.

4. The mounting system of claim 1 wherein the vertical support element is cylindrical in cross-section.

5. The mounting system of claim 1 wherein the vertical support element is polygonal in cross-section.

6. The mounting system of claim 1 wherein there is one horizontal support element.

7. The mounting system of claim 1 wherein there are multiple horizontal support elements.

8. The mounting system of claim 1 wherein there is one clamping element for each horizontal support element.

9. The mounting system of claim 1 wherein there are multiple clamping elements for each horizontal support element.

10. The mounting system of claim 1 wherein said connecting element is a U bolt.

11. The adjustable mounting system used in combination with a wall-mounted shelf unit of claim 1, wherein the shelf unit comprises two side panels, and a top panel and a bottom panel which top and bottom panels are connected at opposite ends of both of said side panels, and wherein said horizontal element extends from one side panel to the other, and said vertical element extends from said top panel to said bottom panel.

12. A method for mounting the shelf unit as claimed in claim 11 on a wall or other mounting surface comprising:

attaching said clamping brackets to said wall or other mounting surface;

connecting said horizontal support element to said clamping brackets so that said horizontal support element is positioned within said region of said clamping bracket;

optionally laterally positioning said shelf unit by sliding said horizontal support element in said region of said clamping bracket;

positioning said clamping element anterior to said vertical support element;

passing a connecting element around said horizontal support element;

connecting said connecting element to a clamping element, which clamping element is positioned anterior to said vertical support element; and tightening the connection between the connecting element and the clamping element, in order to cause rotation of said shelf unit around said horizontal support element.

* * * * *